US008695964B2

(12) United States Patent
Hamaguchi et al.

(10) Patent No.: US 8,695,964 B2
(45) Date of Patent: Apr. 15, 2014

(54) SHEET CONVEYING DEVICE

(75) Inventors: Masanori Hamaguchi, Aichi (JP); Takaaki Mukai, Aichi (JP); Ryoichi Matsushima, Aichi (JP); Kotaro Kurokawa, Aichi (JP); Hiroyuki Shingai, Aichi (JP); Kazutoshi Nakamura, Aichi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 187 days.

(21) Appl. No.: 13/070,591

(22) Filed: Mar. 24, 2011

(65) Prior Publication Data

US 2012/0043714 A1 Feb. 23, 2012

(30) Foreign Application Priority Data

Aug. 20, 2010 (JP) ..... 2010-185176
Dec. 10, 2010 (JP) ..... 2010-275810

(51) Int. Cl.
*B65H 3/52* (2006.01)

(52) U.S. Cl.
USPC ..... 271/121; 271/124

(58) Field of Classification Search
USPC ..... 271/121, 122, 124
See application file for complete search history.

(56) References Cited

U.S. PATENT DOCUMENTS 4,319,741 A 3/1982 Okamoto
4,865,306 A 9/1989 Himegi
6,318,716 B1 * 11/2001 Okuda ..... 271/121
6,540,221 B2 4/2003 Nakashima et al.
6,948,710 B2 * 9/2005 Togashi et al. ..... 271/124
7,497,432 B2 3/2009 Ikeda
2005/0200071 A1 9/2005 Ikeda
2007/0235919 A1 10/2007 Kawamura
2012/0049438 A1 * 3/2012 Akimatsu et al. ..... 271/121

FOREIGN PATENT DOCUMENTS

JP 64-008147 1/1989
JP 02-064540 5/1990
JP 2-64540 U 5/1990
JP 06-080266 3/1994
JP 07-133033 A 5/1995

(Continued)

OTHER PUBLICATIONS

Notice of Reasons for Rejection issued in corresponding Japanese Patent Application No. 2010-191011 dated Dec. 18, 2012.

(Continued)

*Primary Examiner* — Michael McCullough
*Assistant Examiner* — Howard Sanders
(74) *Attorney, Agent, or Firm* — Banner & Witcoff, Ltd.

(57) ABSTRACT

A sheet conveying device to convey a sheet in a sheet path is provided. The sheet conveying device includes a separator roller, which is arranged to be rotatably in contact with the sheet to apply conveying force to the sheet, a pad assembly including a separator pad, which is arranged to be in contact with the sheet stack to apply convey resistance to the sheet stack, and a holder, which is swingably attached to a base member and holds the separator pad, the base member being in a fixed position with respect to the separator roller, a spring, which urges the pad assembly toward the separator roller, and a slidable member, which is attached to the pad assembly to be integrally movable with the pad assembly and to be slidably in contact with a first slidable section in the base member.

13 Claims, 12 Drawing Sheets

(56) References Cited

FOREIGN PATENT DOCUMENTS

| | | | |
|---|---|---|---|
| JP | 08-133511 | A | 5/1996 |
| JP | 2000-191165 | A | 7/2000 |
| JP | 2005-060091 | A | 3/2005 |
| JP | 2005-067784 | A | 3/2005 |
| JP | 2005-255385 | | 9/2005 |
| JP | 2007-076899 | A | 3/2007 |

OTHER PUBLICATIONS

Notice of Allowance issued in related U.S. Appl. No. 13/219,226 dated Jan. 11, 2013.

Non Final Office Action issued in related U.S. Appl. No. 13/219,226 dated Aug. 3, 2012.

Japanese Patent Application No. 2010-191011—Decision of Final Rejection mailed Mar. 12, 2013.

First Office Action and Search Report issued in corresponding Chinese Application No. 201110247705 mailed Oct. 29, 2013.

Final Office Action issued in U.S. Appl. No. 13/219,226 mailed May 7, 2013.

Notice of Allowance issued in corresponding U.S. Appl. No. 13/219,226 mailed Aug. 20, 2013.

Notification of Reasons for Rejection issued in corresponding Japanese Patent Application No. 2010-275810 mailed Dec. 17, 2013.

* cited by examiner

SHEET CONVEYING DEVICE

CROSS REFERENCE TO RELATED APPLICATION

This application claims priority from Japanese Patent Application No. 2010-185176, filed on Aug. 20, 2010, and Japanese Patent Application No 2010-275810, filed on Dec. 10, 2010, the entire subject matters of which are incorporated herein by reference.

BACKGROUND

1. Technical Field

An aspect of the present invention relates to a sheet conveying device, which is capable of conveying a sheet separately from a sheet stack, stacked along a direction of thickness, in a sheet path.

2. Related Art

A sheet conveying device, which can convey sheets stacked along a direction of thickness (i.e., along a direction of height of the sheet stack) continuously one-by-one flat in a sheet path, is known. The sheet conveying device may have a separator roller, which is rotatable on one side of the sheet stack along the direction of height, and a separator pad, which is arranged on the other side of the height across the sheet stack. As the separator roller rotates, conveying force may be applied to the sheet at the one end in the height of the sheet stack, and convey resistance (i.e., friction resistance) may be applied to the sheet at the other end of the sheet stack. Thus, solely the sheet at the one end being in contact with the separator roller can be frictionally forwarded by the separator roller in the sheet path whilst the remaining of the sheets in the sheet stack may be maintained at the position by the friction resistance from the separator pad and restricted from being conveyed along with the separated sheet.

SUMMARY

Whilst the remaining sheets in the sheet stack are separated from the forwarded sheet by the friction force being produced in the separator pad, a pad assembly, including the separator pad and a holder to hold the separator pad, may self-excitedly vibrate and generate undesirable noise.

The noise due to the self-excited vibration may be reduced by having an weight, which is provided to the holder, to some extent; however, the weight may not always remove the noise desirably. Thus, reducing the noise to a desired level has been difficult.

In view of the difficulty, the present invention is advantageous in that a sheet conveying device, in which noise in the pad assembly with the separator pad is reduced, is provided.

According to an aspect of the present invention, a sheet conveying device, which conveys a sheet in a sheet path separately from a sheet stack, is provided. The sheet conveying device includes a separator roller, which is arranged in a position on one end of the sheet stack along a direction of height of the sheet stack to be rotatably in contact with the sheet to apply conveying force to the sheet, a pad assembly including a separator pad, which is arranged in a position on the other end of the sheet stack to be in contact with the sheet stack to apply convey resistance to the sheet stack, and a holder, which is swingably attached to a base member and holds the separator pad, the base member being in a fixed position with respect to the separator roller, a spring, which urges the pad assembly toward the separator roller, and a slidable member, which is attached to the pad assembly to be integrally movable with the pad assembly and to be slidably in contact with a first slidable section in the base member.

BRIEF DESCRIPTION OF THE ACCOMPANYING DRAWINGS

DETAILED DESCRIPTION

Hereinafter, embodiments of the present invention will be described with reference to the accompanying drawings. An auto document feeder (ADF) 10 (see FIG. 1) in an image reading apparatus is a sheet conveying device to feed sheets one-by-one to the image reading apparatus to convey along a sheet path.

First Embodiment

1. Overall Configuration of the ADF

Figure 1:
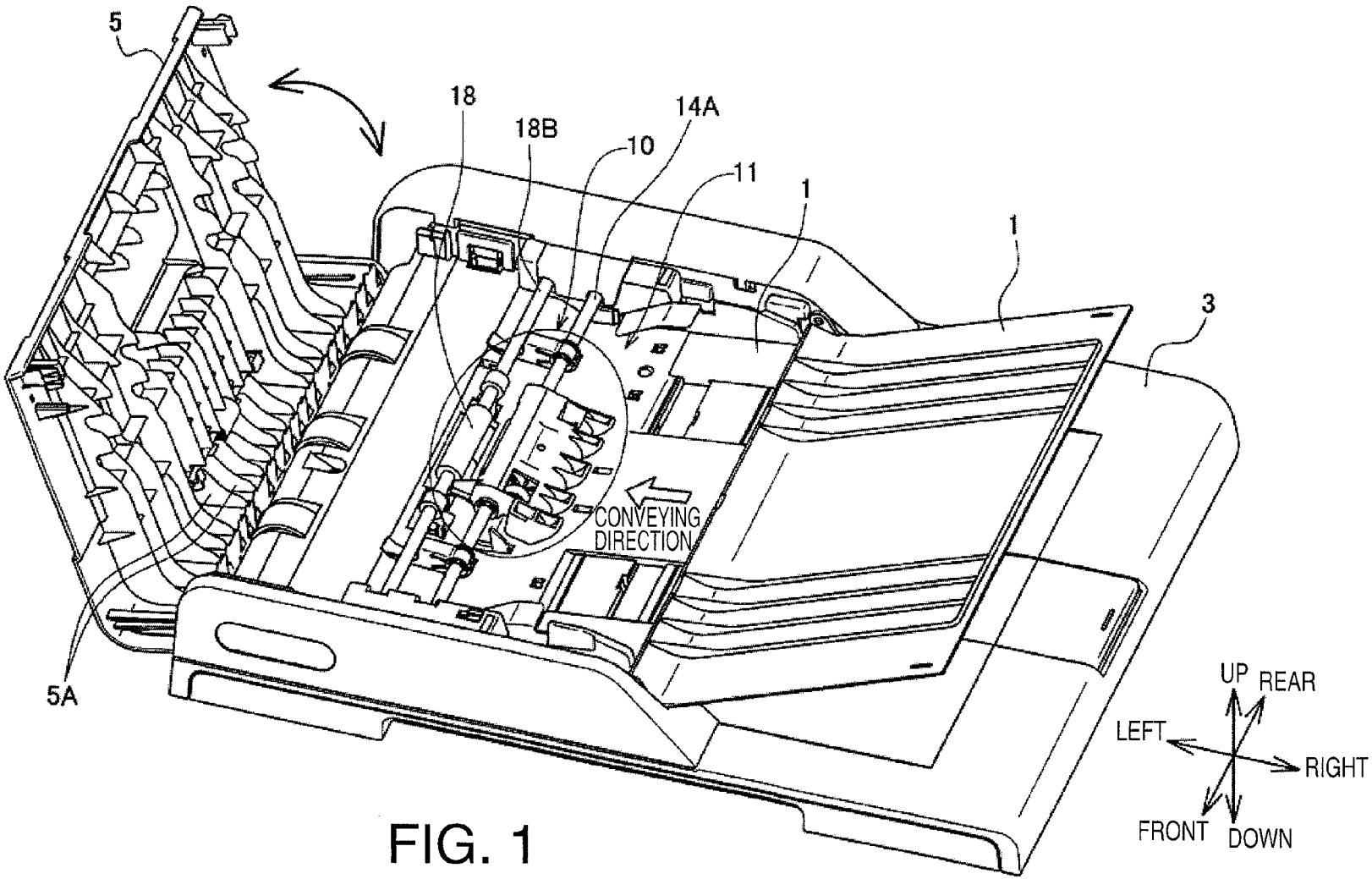
FIG. 1 is a perspective view of an image reading apparatus with an auto document feeder (ADF) according to embodiments of the present invention with a top cover being open.

The ADF 10 is a feeder device to pick up original sheets stacked vertically along a direction of thickness in a sheet tray 1 separately and feed the picked-up sheet one-by-one to a reader unit (not shown). The sheet conveyed to the reader unit along a sheet path is scanned to have an original image appearing on the original sheet conveyed and read by the reader unit and further carried to be released in a discharge tray 3. Although FIG. 1 shows the ADF 10 with a top cover 5 being opened, when the sheet is carried in the sheet path, the top cover 5 is closed to cover internal components of the ADF 10. The sheet path illustrated in a thick arrow can be seen in FIG. 2. The sheet path starts at the original sheet tray 1 and ends at the discharge tray 3. In other words, whilst the sheets are conveyed in one way in the sheet path, the original sheet tray 1 is at a most upstream position in the sheet path, and the discharge tray 3 is a most downstream position in the sheet path.

The top cover 5 is rotatably attached to a base cover 11, in which the original sheet tray 1 is formed. The top cover 5 is formed to have a plurality of ribs 5A, which extend along a direction of sheet conveyance when the top cover 5 is closed, on an inner surface thereof. When the top cover 5 is closed, the sheet being carried along the sheet path becomes in contact with edges of the ribs 5A and guided thereby. Thus, the top cover 5 protects the inner components of the ADF 10 and serves as a part of the sheet path as well as the base cover 11.

In the ADF 10 according to the embodiments, the original sheets stacked in the original sheet tray 1 are picked up one-by-one from top and conveyed in the sheet path toward the reader unit. In particular, the sheets in the original sheet tray 1 are drawn into an intake section 13 and forwarded to a separating section 12, in which a topmost sheet in the layered sheets forwarded from the intake section 13 is separated from the other sheets (see FIG. 2), along the sheet path.

The separating section 12 includes a separator roller 14, a pad assembly 15, and a spring 16. The separator roller 14 is arranged on one end (e.g., an upper side) of the sheet stack along a direction of height of the sheet stack to be rotatably in contact with a sheet at the one side of the sheet stack (e.g., a sheet at a top end of the sheet stack). Thus, the rotating separator roller 14 applies conveying force to the topmost sheet in the sheet stack.

Figure 11:
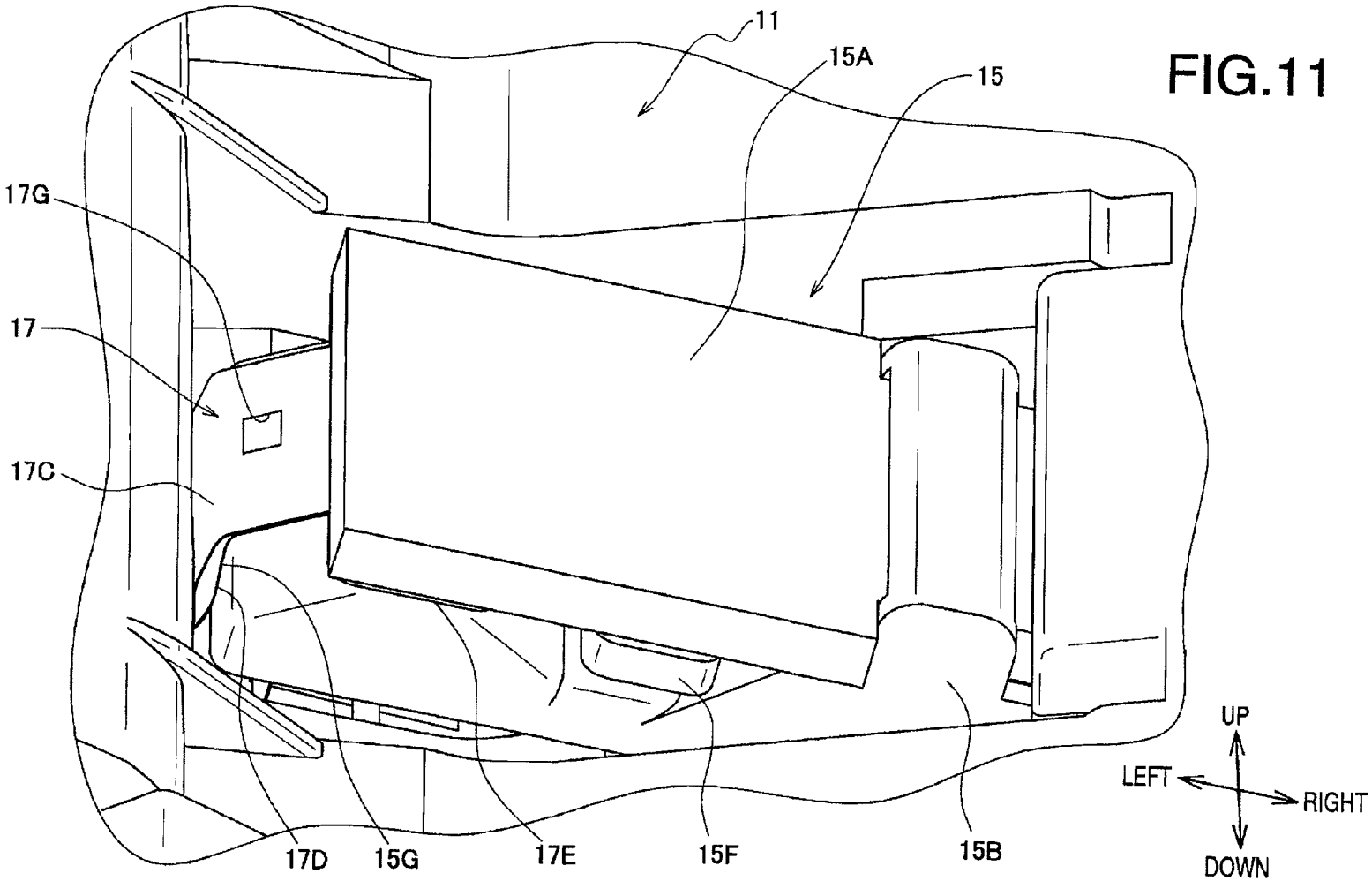
FIG. 11 is a perspective partial view of the pad assembly in the ADF according to the fourth embodiment of the present invention without the separator roller.

The separator roller 14 is rotatably attached to the base cover 11 via a shaft 14A (see FIG. 11) and is rotated by driving force transmitted from a drive source (not shown) to the shaft 14A. Thus, the separator roller 14 is maintained in a fixed position with respect to the base cover 11, and vice versa.

The pad assembly 15 includes a separator pad 15A and a holder 15B. The separator pad 15A is arranged on an opposite side from the separator roller 14 across the sheet stack, i.e., on the other end (e.g., a lower side) of the height of the sheet stack. The separator pad 15A is arranged to be in contact with a sheet at the other end (e.g., at the lower end) of the sheet stack and applies convey resistance to the sheet stack. The separator pad 15A is made of a flexible material, such as silicon rubber, which can generate friction resistance with the sheets.

The holder 15B to hold the separator pad 15A is swingably attached to the base cover 11 and accommodated in a recess 11A formed in the base cover 11. The holder 15B includes an integrally-formed swing shaft 15 and is made of resin, such as POM, which has adequate mechanical strength.

Figure 3:
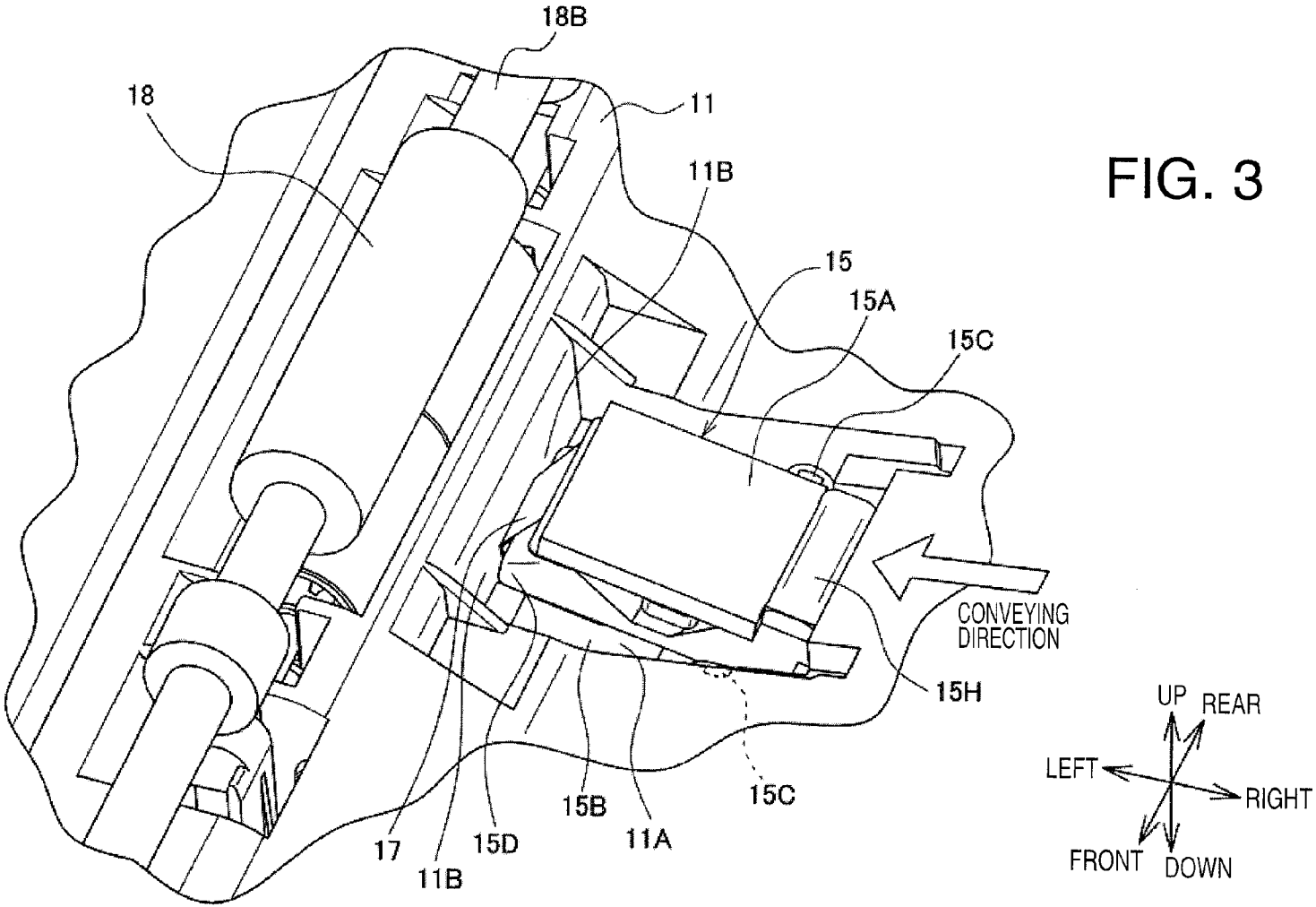
FIG. 3 is a perspective partial view of the ADF without a separator roller according to the first embodiment of the present invention.

The holder 15B is arranged in an orientation to have the swing shaft 15C thereof to be in an upstream position along the direction of sheet conveyance with respect to the holder 15B whilst the swing shaft 15C extends along a direction orthogonal to the direction of thickness of the sheet being conveyed. The direction orthogonal to the direction of thickness of the sheet being conveyed corresponds to, according to the present embodiment, a front-rear direction of the ADF 10 (see FIG. 3). The front-rear direction of the ADF 10 may also be referred to as a direction of depth of the ADF 10. In the present embodiment, further, an end of the pad assembly 15 furthest from the swing shaft 15C (i.e., a most downstream end of the pad assembly 15) along the direction orthogonal to the swing shaft 15C is referred to as a swingable end 15D. In the following description, unless otherwise noted, the "end of the pad assembly 15" refers to the swingable end 15D.

The holder 15B includes a fixing piece 15H, which is formed in an upstream end position in the holder 15B, to hold the separator pad 15A. The holder 15B is further formed to have a recessed section 15J in a midst position between the swingable end 15D and the fixing piece 15H. The holder 15B is arranged not to be in contact with the recessed section 15J but in contact with the separator pad 15A at the swingable end 15D and the fixing piece 15H. Meanwhile, the separator pad 15 is bendable toward the recessed section 15J. Therefore, the separator pad 15A can be deformed to extend along the sheet being conveyed in the sheet path.

The spring 16 is a coil spring arranged at a bottom of the recess 11A of the base cover 11 in a position between the pad assembly 15 and the base cover 11. Expanding force of the spring 16 urges the pad assembly 15 to be away from the base cover 11 upwardly toward the separator roller 14. Therefore, when the separator roller 14 is not attached to the base cover 11 (see FIG. 3), the swingable end 15D of the pad assembly 15 tends to be lifted upwardly to protrude out from the recess 11A of the base cover 11.

The pad assembly 15 further includes a sheet of slidable film 17, which extends to droop downward from an end of the holder 15 closer to the swingable end 15D toward the downstream side of the pad assembly 15 beyond the swingable end 15D. In the present embodiment, the slidable film 17 is fixed to a lower surface of the separator pad 15A at one end (more specifically, a lower surface of an enhancing film 15E attached to the lower surface of the separator pad 15A) (see FIG. 5), and the other free end of the slidable film 17 droops downward in clearance reserved in between an inner surface 11B of the recess 11A and the holder B. The inner surface 11B rises vertically to face the swingable end 15D of the holder 15B (see FIG. 2). When the pad assembly 15 is installed in the recess 11A of the base cover 11, the slidable film 17 is in surface contact with the inner surface 11B of the recess 11A within a range between the fixed end and the drooping end thereof. Hereinafter, the inner surface 11B of the recess 11A may be also referred to as a first slidable section 11B. The slidable film 17 is also in surface contact with a second slidable section 15G in the swingable end 15D, which faces the first slidable section 11B of the inner plane 11A across the clearance, when the pad assembly 15 is installed in the recess 11A.

With the slidable film 17 being in contact with the first slidable section 11B of the base cover 11 and the second slidable section 15G of the holder 15B, when the pad assembly 15 is urged to be swingably uplifted, the slidable film 17 is slidably uplifted along with the swing movement of the pad assembly 15 to slide with respect to the first slidable section 11B and the second slidable section 15G, and friction resistance is caused in the contacting sections, i.e., between the slidable film 17 and the first slidable section 11B and between the slidable film 17 and the second slidable section 15G.

Figure 5:
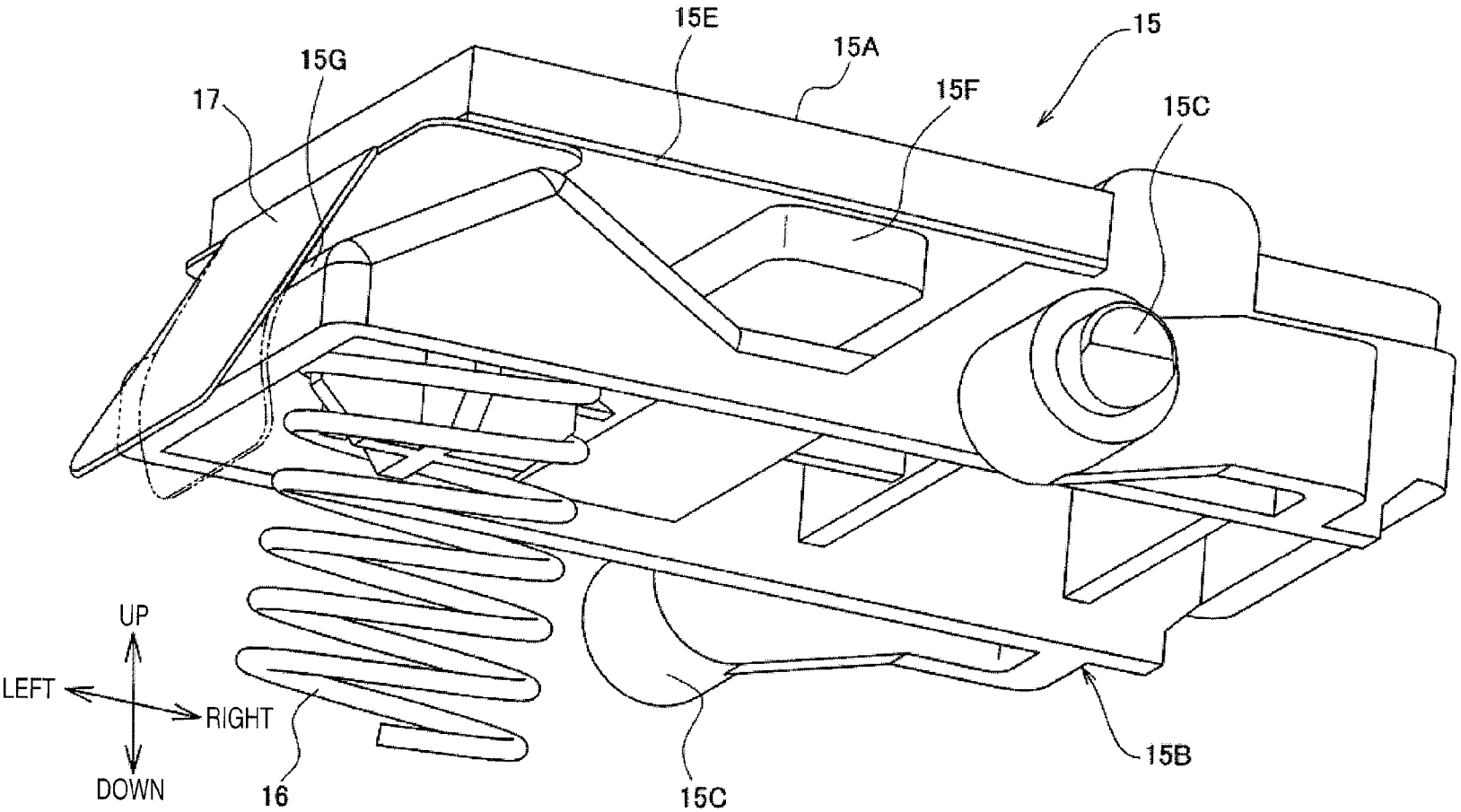
FIG. 5 is a perspective bottom view of the pad assembly in the ADF according to the first embodiment of the present invention.

The slidable film 17 is made of resiliently deformable resin, such as PET (polyethylene terephthalate), and before the pad assembly 15 is installed in the base cover 11, the slidable film 17 in an original condition linearly extends from the separator pad 15A downwardly, as illustrated in solid lines in FIG. 5. However, once the pad assembly 15 is installed in the recess 11A of the base cover 11, the drooping end of the slidable film 17 in the clearance is deformed in an arc, as illustrated in double-dotted lines in FIG. 5, to reach a bottom surface of the recess 11A.

Therefore, in the recess 11A, the deformed slidable film 17 tends to recover to its undeformed linear condition and applies force F1 (see FIG. 2), which tends to urge the second slidable section 15G to be away from the first slidable section 11B, to the holder 15B whilst being slidably in contact with the first slidable section 11B and the second slidable section 15B. At the same time, the slidable film 17 is affected by reaction force from the holder 15B.

The reaction force to the slidable film 17 is transmitted to affect the first slidable section 11B as reaction force F2 (see FIG. 2), which causes friction force in a section between the slidable film 17 and the slidable section 11B. Meanwhile, friction force is caused in a section between the slidable film 17 and the second slidable section 15G due to the force F1. It is to be noted that, in the above description, the force F2 is referred to as the reaction force to the force F1; however, it can be also interpreted that the forcer F1 is reaction force to the force F2.

Figure 4:
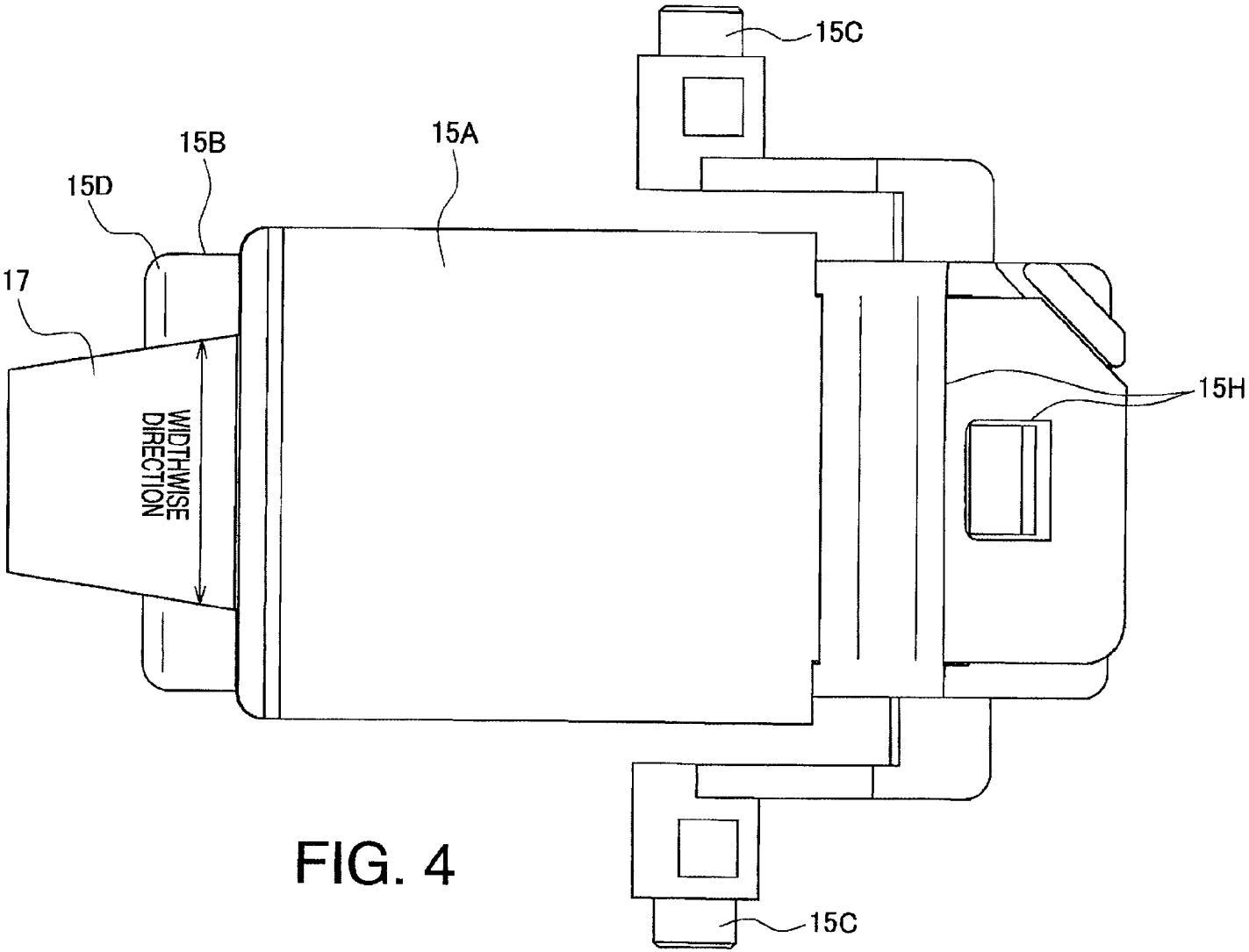
FIG. 4 is a top plane view of the pad assembly of the ADF according to the first embodiment of the present invention.

As shown in FIG. 4, the slidable film 17 according to the present embodiment is formed to have a shape of trapezoid, of which side at the drooping end is smaller whilst the other side fixed to the separator pad 15*a* is greater, and which is line-symmetrical about a widthwise center thereof. According to the present embodiment, a widthwise direction of the slidable film 17 refers to a direction, which extends orthogonally to a direction of thickness of the slidable film 17 and to an extending direction of the slidable film 17. The widthwise center of the slidable film 17 refers to a center of the trapezoid along the widthwise direction.

As mentioned above, the lower surface of the separator pad 15A, is partially enhanced by the enhancing film 15E, and the slidable film 17 is fixed to the lower surface of the enhancing film 15E. The lower surface of the separator pad 15A is on the opposite side from the separator roller 14 and closer side to the holder 15B with respect to the separator roller 14. On the lower surface of the enhancing film 15E, a weight 15F to reduce self-excited vibration of the pad assembly 15 is attached.

The intake section 13 (see FIG. 2) in the ADF 10 includes a pickup roller 13A, which is arranged on a same side with the separator roller 14 with respect to the sheet path in a position to become rotatably in contact with the sheet. As the pickup roller 13A rotates, conveying force is applied to the sheet, and the sheet is forwarded to the separator roller 14. The pickup roller 13A is rotated by driving force via a shaft 14A and other intervening components (e.g., gears and belts) in mechanically cooperation with the separator roller 14.

In downstream positions with respect to the separating section 12 along the sheet path, a conveyer roller 18, which conveys the sheet passed from the separating section 12 further in the sheet path, and a pinch roller 18A, which urges the sheet against the conveyer roller 18, are arranged. The conveyer roller 18 is driven by driving force transmitted to a shaft 18B (see FIG. 1) and rotated in mechanically cooperation with the separator roller 14.

2. Separating and Conveying Behaviors in the ADF

Behaviors of the ADF 10 to separate and convey the sheet in the sheet path will be described in detail. The sheets conveyed from the original sheet tray 1 by the intake section 13 are drawn in the separating section 12 in the position between the separator roller 14 and the separator pad 15A. Amongst the layered sheets drawn in the separating section 12, solely a sheet being in contact with the separator roller 14 (e.g., the topmost sheet) is conveyed further from the separating section 12.

More specifically, the remaining of the sheets, which are closer to the separator pad 15A than the contacting topmost sheet, are held thereat by the convey resistance from the separator pad 15A. Thus, the sheets conveyed to the separating section 12 are conveyed one-by-one further in the sheet path toward the reader unit.

In this regard, a number of the sheets conveyed to the separating section 12 or thickness of the sheets conveyed to the separating section 12 may vary; however, the difference of the number or the thickness is absorbed by the pad assembly 15, which is swingable to move closer to or further from the base cover 11.

When the pad assembly 15 swings, the spring 16 expands or contracts to change intensity of the pressure to urge the separator pad 15A against the sheets. Therefore, in the present embodiment, in order to reduce an amount of intensity variation, coefficient of the spring 16 is maintained to be smaller by, for example, increasing a number of coils in the spring 16.

3. Features of the ADF

According to the present embodiment, the ADF 10 is provided with the slidable film 17, which is slidable with the first slidable section 11B in the base cover 11 and integrally movable with the pad assembly 15 with respect to the base cover 11. Therefore, when the pad assembly 15 is vibrated by self-excitation, the vibration can be dampened promptly by the friction resistance caused in the slidable film 17 being slidably in contact with the first slidable section 11B in the base cover 11. Accordingly, noise which may be caused by the self-excited vibration can be reduced.

According to the configuration described above, further, the slidable film 17 is arranged to be slidably in contact with the second slidable section 15G in the pad assembly 15. Therefore, the self-excitation can be diminished in the slidable film 17, and noise can be prevented from being generated.

According to the configuration described above, the separator pad 15A is a resilient piece, which is made of, for example, silicon rubber and can provide damping force. In this regard, the self-excited vibration caused in the pad assembly 15 can be absorbed in the separator pad 15A to some extent. However, the vibration may be maintained in the holder 15B, which is rather rigid. Therefore, with the second slidable section 15B in the holder 15B, the self-excited vibration in the holder 15B can be dampened within the holder 15B. Accordingly, the noise which may otherwise be caused in the pad assembly 15 by the self-excited vibration can be effectively reduced.

According to the configuration described above, the slidable film 17 is arranged in the section closer to the swingable end 15D, in which vibration can be more largely amplified than a section closer to, for example, the swing shaft 15C, in the pad assembly 15. Therefore, with the slidable film 17 at the position closer to the swingable end 15D, the self-excited vibration, which may otherwise be amplified, can be effectively reduced.

According to the configuration described above, the slidable film 17 is made of a resiliently deformable material; therefore, the self-excited vibration in the pad assembly 15 can be efficiently absorbed to be dampened in the slidable film 17.

According to the configuration described above, the slidable film 17 is a sheet-type film, having surfaces to be in surface contact with the first slidable section 11B and with the second slidable section 15G. Therefore, the base cover 11 and the holder 11B can be steadily in contact with the slidable film 17 at the first slidable section 11B and the second slidable section 15G respectively to effectively dampen the self-excited vibration.

Figure 2:
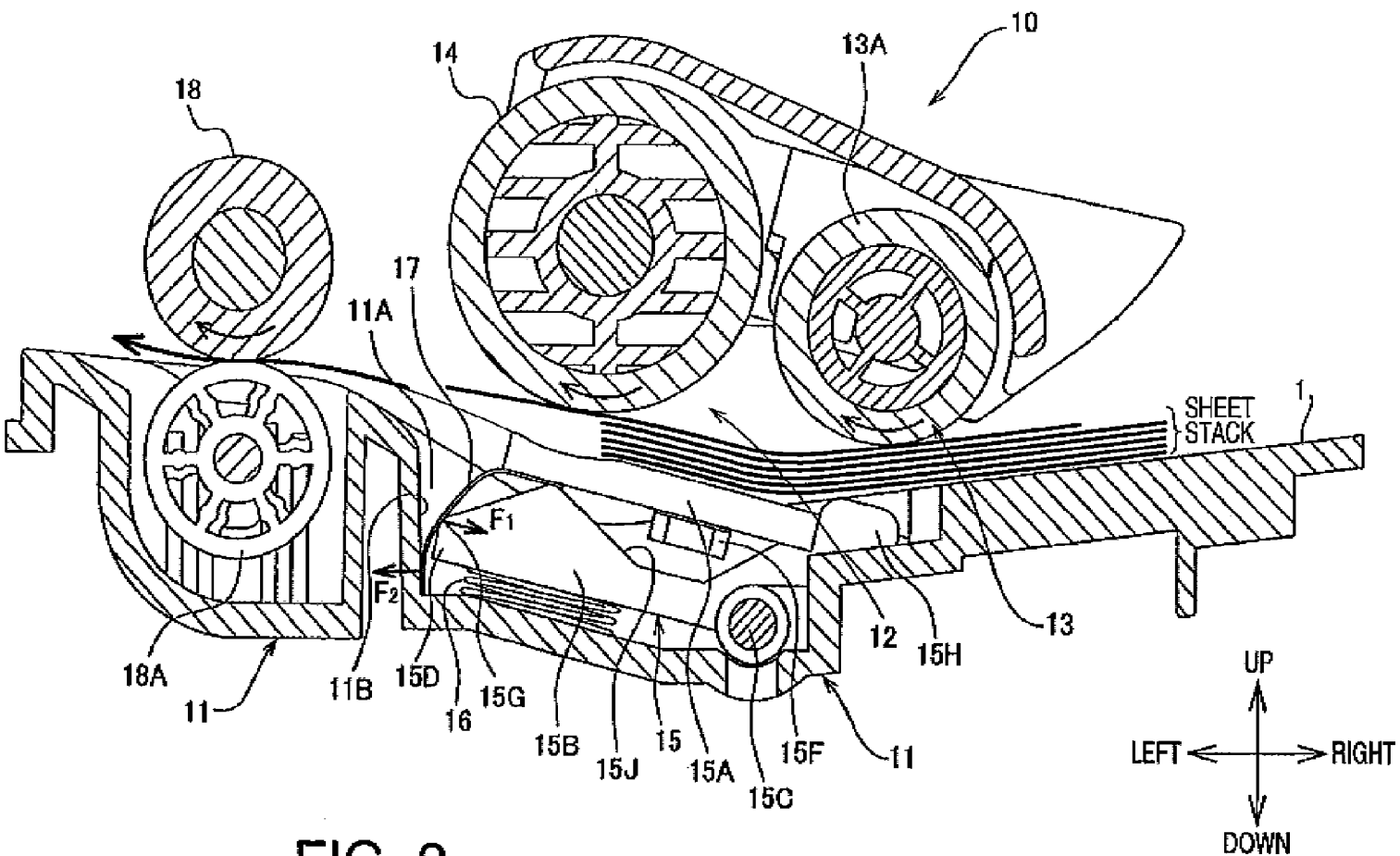
FIG. 2 is a cross-sectional side view of a pad assembly in the ADF according to a first embodiment of the present invention.

According to the above configuration, the slidable film 17 is arranged to droop downward from the end of the separator pad 15A closer to the swingable end 15D to the downstream side of the pad assembly 15 and to be slidably in contact with the first slidable section 11B, which faces the swingable end 15D via the clearance. In other words, as shown in FIG. 2, the clearance between the first slidable section 11B and the swingable end 15D is at least partially covered by the slidable film 17, and the sheet being conveyed in the sheet path can be blocked by the slidable film 17 and prevented from being undesirably caught in the clearance. When, for example, a front end of the sheet being conveyed is deformed (e.g., curled), the sheet may accidentally be caught in the clearance and jammed in the sheet path. With the slidable film 17 blocking the clearance, however, the sheet can be prevented from being caught, and sheet jam can be prevented. It is to be noted, in terms of the sheet being conveyed, that the "front end" refers to an edge of the sheet which comes earlier in the sheet path than the other part of the sheet.

According to the configuration described above, the slidable film 17 is formed to have a shape of trapezoid, of which side at the drooping end is smaller whilst the other side fixed to the separator pad 15*a* is greater, and which is symmetrical about a widthwise center line thereof (see FIG. 4).

When resistance force (i.e., the friction force) occurring in the contacting sections between the slidable film 17 and the first slidable section 11B is uneven within the widthwise range in the slidable film 17, torsion moment to twist the slidable film may be generated, and the slidable film 17 may self-excitedly vibrate in a different vibration mode from the self-excited vibration of the pad assembly 15. As a result, different noise may be generated.

Whilst the torsion moment may occur due to the uneven distribution of the resistance force within the widthwise range, and a volume of the torsion moment depends on multiplication of a distance between the widthwise center and a widthwise end by the friction force, the volume of the torsion moment becomes smaller when the width of the slidable film 17 is smaller.

In this regard, due to the trapezoidal shape of the slidable film 17, even when the resistance force (i.e., the friction force) is unevenly distributed within the widthwise range, the torsion moment occurring in the slidable film 17 may be reduced to be smaller.

According to the configuration described above, the base cover 11 is formed to have the recess 11A, in which the holder 15B is accommodated. Further, the recess 11A is formed to have the first slidable section 11B being the inner surface, which faces the swingable end 15D of the holder 15B. Meanwhile, the slidable film 17 is arranged in the resiliently deformed condition in the pad assembly 15 to be in contact with the first slidable section 11B and the second slidable section 15G with the free end thereof drooping downward. Therefore, a greater volume of resistance force (i.e., the friction force) can be generated in the first slidable section 11B and the second slidable section 15G with the slidable film 17, and the self-excited vibration can be promptly dampened.

According to the configuration described above, the directions, in which the slidable film 17 urges the first slidable section 11B and the second slidable section 15G are orthogonal to the axial direction of the swing shaft 15C. Therefore, the swing shaft 15C tends to be urged to an inner peripheral surface of a shaft hole (not shown) via the swing shaft 15C. Accordingly, noise, which may otherwise be generated periodically each time the swing shaft 15C collides with the inner peripheral surface of the shaft hole, can be prevented. The shaft hole according to the present embodiment is a hole, in which the swing shaft 15C is rotatably inserted, and may be formed in the base cover 11.

Thus, with the second slidable section 15G provided in the position to face the first slidable section 11B, and with the slidable film 17 applying the force F1, which urges the second slidable section 15G to be further away from the first slidable section 11B, to the holder 15B, the swing shaft 15C can be in close contact with the inner peripheral surface of the shaft hole, whilst the swing shaft 15C is rotatable. Therefore, collision of the swing shaft 15C with the shaft hole, which may otherwise occur periodically, may be prevented, and the noise due to the possible collision may be prevented whilst the self-excited vibration in the holder 15B can be effectively dampened.

Second Embodiment

Figure 6:
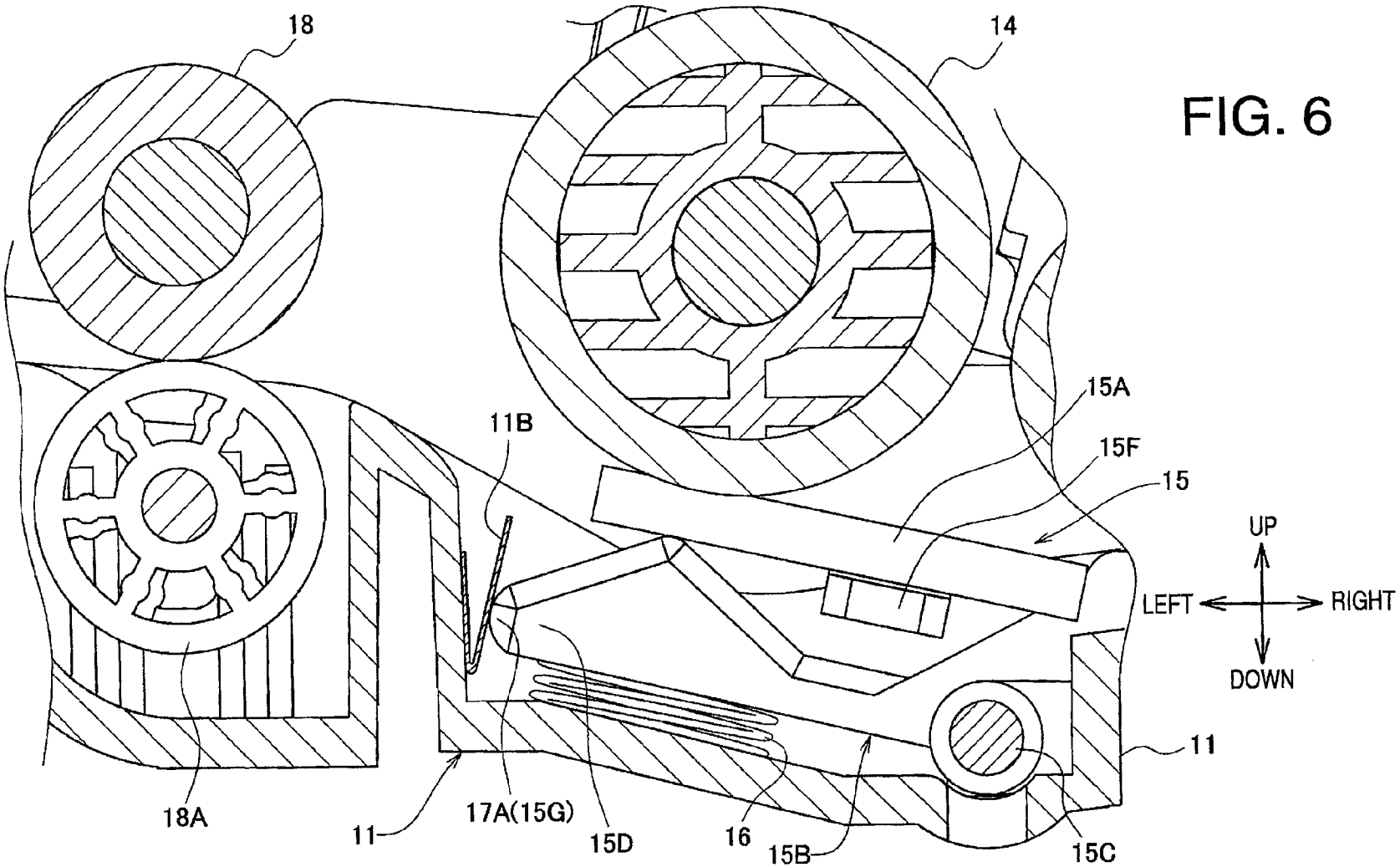
FIG. 6 is a cross-sectional side view the pad assembly in the ADF according to a second embodiment of the present invention.

A second embodiment of the present invention will be described hereinbelow. In the present embodiment, the slidable film 17 employed in the previous embodiment is omitted. Instead, a V-shaped blade spring, in a cross-sectional side view (see FIG. 6), is provided. More specifically, the blade spring to face the swingable end 15D of the holder 15B is fixed to the inner surface of the recess 11A. In the present embodiment, specifically, a part of the blade spring facing the swingable end 15D serves as a first slidable section 11B. Further, the swingable end 15D of the holder 15B is provided with a round-formed slidable surface 17A, which is arranged to be slidably in contact with the first slidable section 11B of the blade spring. Thus, without the sheet of slidable film 17, the holder 15B can be slidable with respect to the first slidable section 11B of the blade spring, which is fixed to the inner surface of the recess 11A.

According to the present embodiment, when the pad assembly 15 is installed in the base cover 11, the slidable surface 17A in the holder 15B is slidably in contact with the first slidable section 11B. Therefore, friction force is generated in the section between the slidable surface 17A and the first slidable section 11B. In other words, the slidable surface 17A generates the sliding resistance (i.e., friction force) and serves as the second slidable section 15G in the previous embodiment simultaneously.

According to the present embodiment, mainly the first slidable section 11B of the blade spring resiliently deforms when the first slidable section 11B and the slidable surface 17A are in slidable contact. However, the first slidable section 11B may not necessarily be resiliently deformable but may be rigid, when, for example, the slidable surface 17A of the holder 15B is resiliently deformable.

For another example, the blade spring having the first slidable section 11B may be integrally formed with the base cover 11. Alternatively, the blade spring may be separately formed from the base cover 11 and fixed to the base cover 11.

Third Embodiment

A third embodiment of the present invention will be described hereinbelow. In the present embodiment, the slidable film 17 is folded in two and fixed to the lower side of the separator pad 15A by an upper-outer surface thereof (see FIGS. 7 and 8). More specifically, The twofold slidable film 17 has a first slidable surface 17C, which is to be slidably in contact with the first slidable section 11B of the base cover 11, and a second slidable section 17D, which is to be slidably in contact with the second slidable section 15G of the pad assembly 15. In the following description, explanation concerning the components equivalent to those described in the first embodiment will be omitted.

1. Configuration of the Pad Assembly

Figure 7:
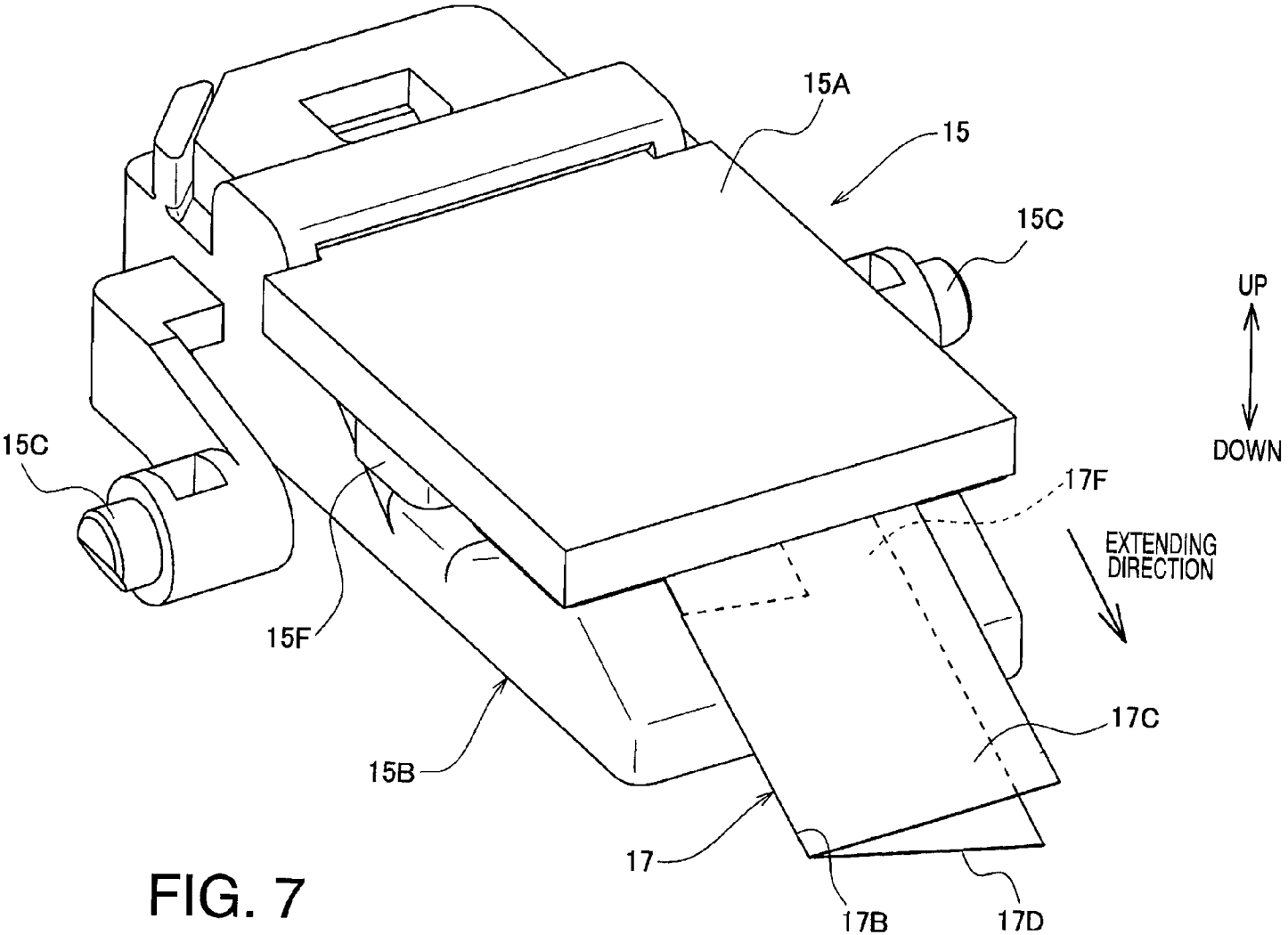
FIG. 7 is a perspective top view of the pad assembly of the ADF according to a third embodiment of the present invention.

The slidable film 17 in the present embodiment is folded in two at a line 17B to form a crease, which extends in parallel with an extending direction (the drooping direction) of the slidable film 17 (see FIG. 7). The twofold slidable film 17 has the first slidable surface 17C on one side thereof and the second slidable surface 17D on the other side thereof across the crease 17B (see FIG. 8).

Figure 8:
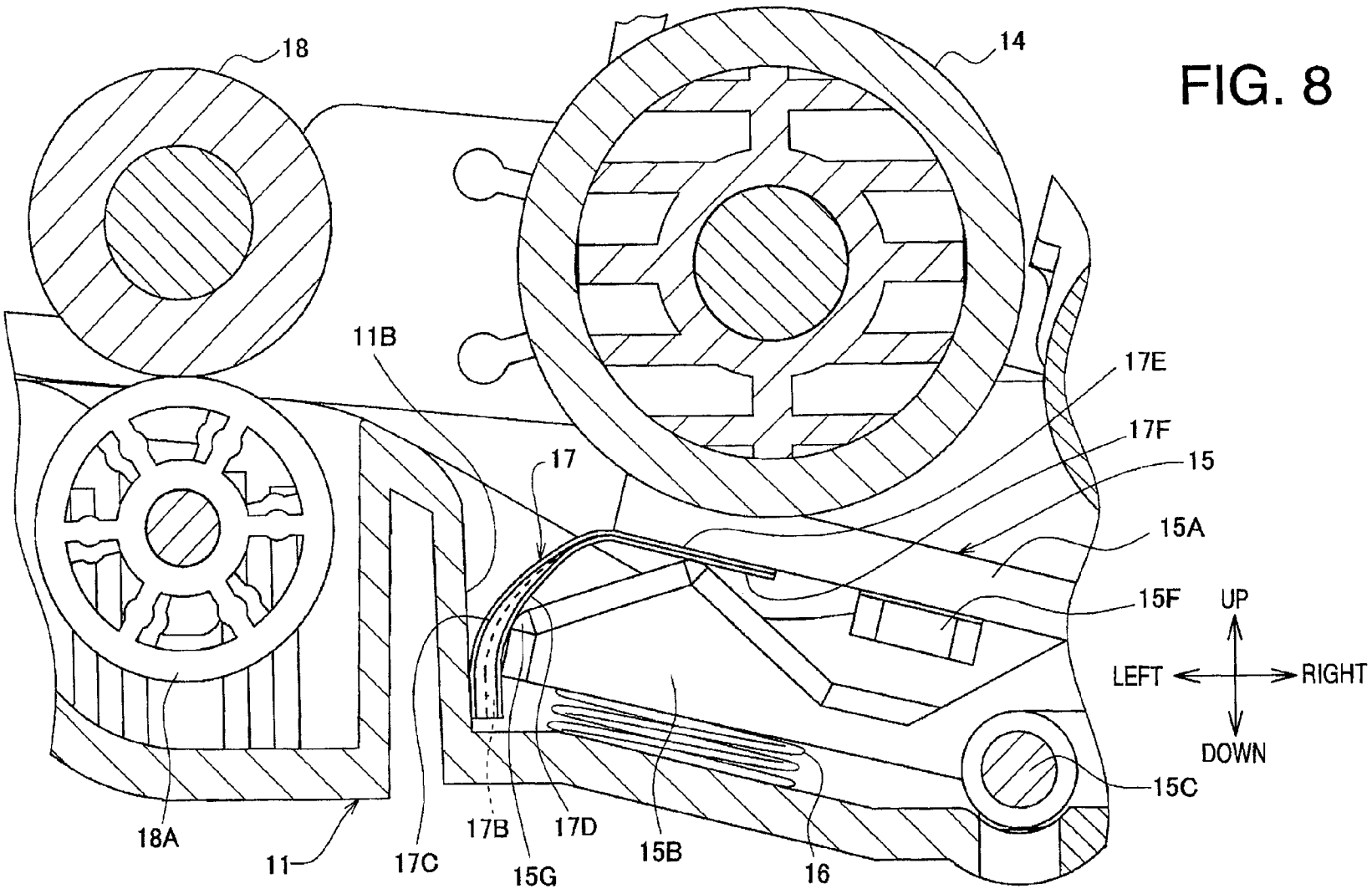
FIG. 8 is a cross-sectional side view the pad assembly in the ADF according to the third embodiment of the present invention.

Before the pad assembly 15 is installed in the base cover 11, as shown in FIG. 7, the slidable film 17 may extend rather linearly. When the pad assembly 15 is installed in the base cover 11, however, as shown in FIG. 8, the extending section of the twofold slidable film 17 is resiliently deformed to be inserted in the clearance between the inner surface of the recess 11A and the holder 15B with first slidable surface 17C and the second slidable surface 17D being urged toward each other. In this regard, resilient force caused in the crease 17B urges the first slidable surface 17C against the first slidable section 11B of the base cover 11 and the second slidable surface 17D against the second slidable section 15G of the pad assembly 15.

Figure 9:
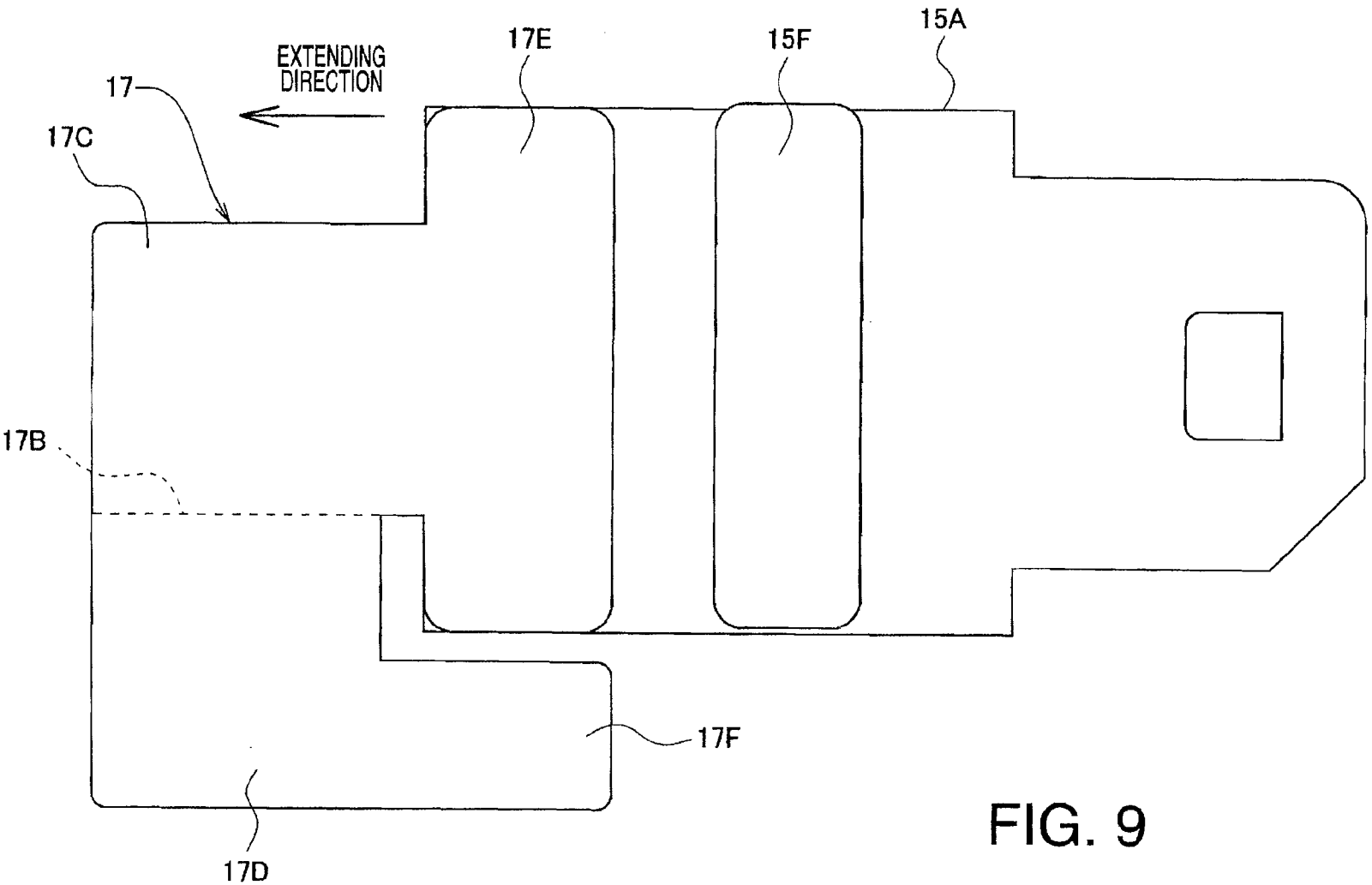
FIG. 9 is a development view of a slidable film to be installed in the pad assembly of the ADF according to the third embodiment of the present invention.

As can be seen in a development view shown in FIG. 9, the slidable film 17 has a fixable section 17E, which is to be fixed to the separator pad 15A, on a same side as the first slidable surface 17C with respect to the crease 17B. Meanwhile, on a same side as the second slidable surface 17C with respect to the crease 17B, the slidable film 17 has a jutting section 17F, which juts along a direction opposite from the extending direction of the slidable film 17.

When the above-described slidable film 17 is folded at the line 17B to be fixed to the separator pad 15A, the fixable section 17E comes to be layered over the jutting section 17F. And when the pad assembly 15 is installed in the base cover 11, the jutting section 17F along with the fixable section 17E is interposed between the separator pad 15A and the holder 15B (see FIG. 8).

2. Features of the ADF and the Pad Assembly

According to the configuration described above, the slidable film 17 having the first slidable surface 17C, which is to be slidably in contact with the first slidable section 11B of the base cover 11, on one side thereof with respect to the crease 17B and the second slidable surface 17D, which is to be slidably in contact with the second slidable section 15G of the holder 15B, on the other side thereof across the crease 17B. Accordingly, the slidable film 17 in the simple configuration can be arranged to be slidably in contact with the base cover 11 and the holder 15B.

In the present embodiment, the slidable film 17 is made of thermoplastic resin, such as PET; therefore, the slidable film 17 may be affected by environmental factors over ages and deformed. For example, if the slidable film 17 is periodically affected by external force due to the self-excited vibration in temperature-variable environment, the slidable film 17 may be deformed to be in a non-contacting position apart from the second slidable section 15G and irreversibly fixed thereat.

Meanwhile, according to the present embodiment, the twofold slidable film 17 provides the first slidable surface 17C and the second slidable surface 17D to be slidably in contact with the base cover 11 and the holder 15B. Further, the resilient force to urge the first slidable surface 17C against the first slidable section 11B and the second slidable surface 17D against the second slidable section 15G can be generated by folding the slidable film 17 and maintained over a longer period of time.

Therefore, even with the aged changes in the slidable film 17 due to the environmental factor, influence of the aging can be moderated. Accordingly, the slidable film 17 can be maintained to be slidably in contact with the first slidable section 11B and the second slidable section 15G, and noise due to the self-excited vibration can be reduced over a longer period of time.

According to the present embodiment, the direction of the crease 17B is in parallel with the extending direction of the slidable film 17. When the crease 17B extends orthogonally to the extending direction of the slidable film 17 (see FIG. 10), a worker to assemble the pad assembly 15 may be required to hold a part of the second slidable surface 17D closer to the fixable section 17E by hand to maintain the second slidable surface 17D folded. In this regard, the hand of the worker may be interfered with by the separator pad 15A, and assembling efficiency for the worker may be undesirably lowered.

In the meantime, as described above, the slidable film 17 according to the present embodiment is folded to have the crease 17B in parallel with the extending direction of the slidable film 17. In this configuration, the worker may hold by hand a portion in vicinity of the crease 17B by, for example, pinching, along with a portion of the second slidable surface 17D without being interfered with by the separator pad 15A. Therefore, the pad assembly 15 can be more easily installed in the base cover 11.

Further, according to the present embodiment, the slidable film 17 is provided with the fixable section 17E, by which the slidable film 17 is fixed to the separator pad 15A, on the same side as the first slidable surface 17C with respect to the crease 17B. Further, the slidable film 17 is provided with the jutting section 17F, which is on the same side as the second slidable surface 17D with respect to the crease 17B. When the slidable film 17 is folded at the line 17B, the jutting section 17F comes to the position between the separator pad 15A and the holder 15B (see FIG. 8). Therefore, slidable film 17 can be more steadily prevented from being unfolded and easily installed in the pad assembly 15 and in the base cover 11.

Fourth Embodiment

A fourth embodiment of the present invention will be described hereinbelow. In the present embodiment, the slidable film 17 has the crease 17B, which runs orthogonally to the extending direction of the slidable film 17, at the drooping end thereof (see FIGS. 10 and 11). As the slidable film 17 is folded inwardly at the line 17B, the slidable film 17 may appear to form a shape of "U" or "V" in a cross-section side view.

Figure 12:
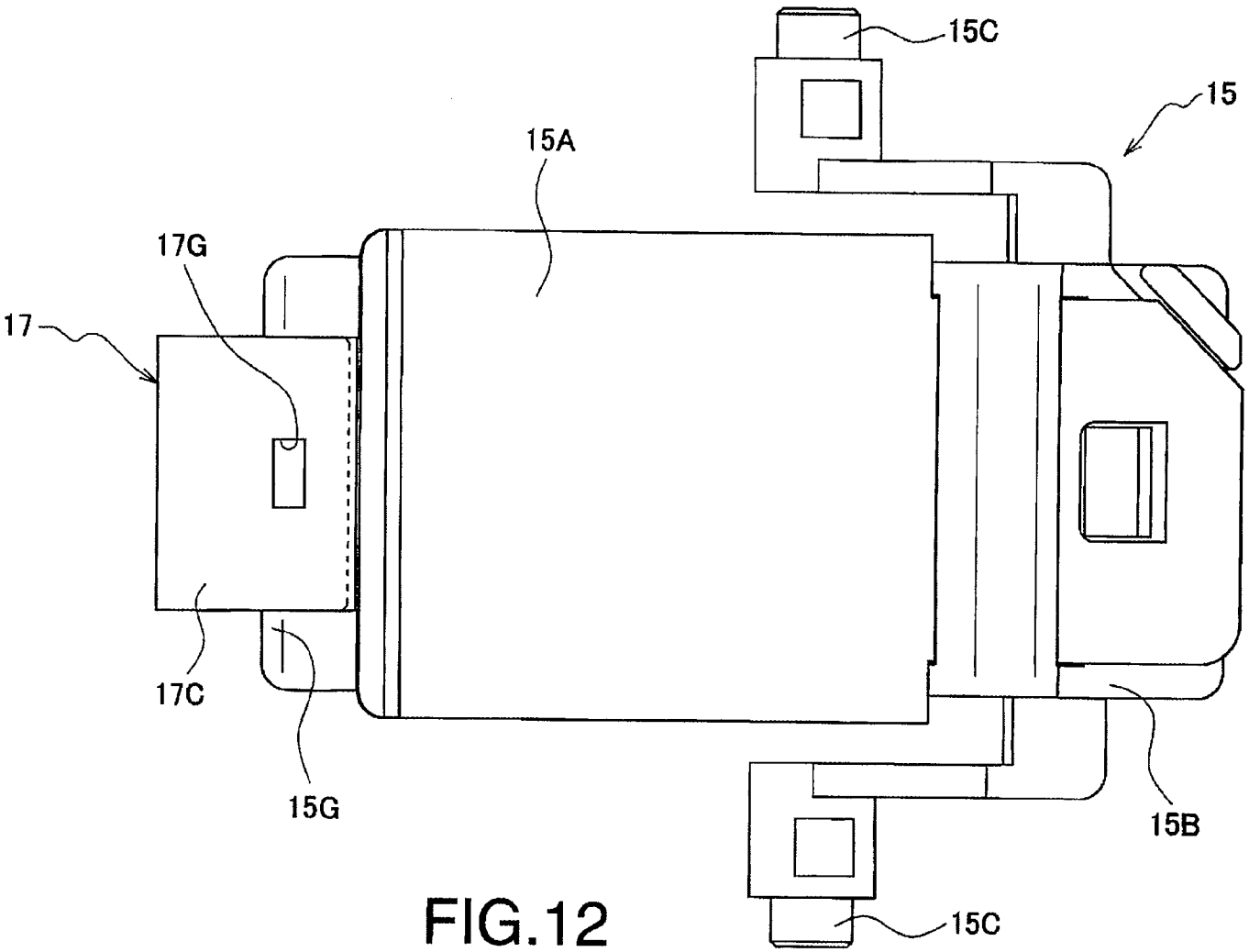
FIG. 12 is a top plane view of the pad assembly of the ADF according to the fourth embodiment of the present invention.

According to the present embodiment, the slidable film 17 has the first slidable surface 17C on an upper outer side thereof, and the second slidable surface 17D is provided on a lower outer side thereof. In other words, the extending section of the slidable film 17 is folded in two to have a backside of the upper outer surface of the slidable film 17 having the first slidable and a backside of the lower outer surface of the slidable film 17 having the second slidable surface 17D face each other. Further, the slidable film 17 is formed to have an opening 17G (see FIG. 12) in the first slidable surface 17C, through which the backside of the second slidable surface 17D can be observed.

Figure 10:
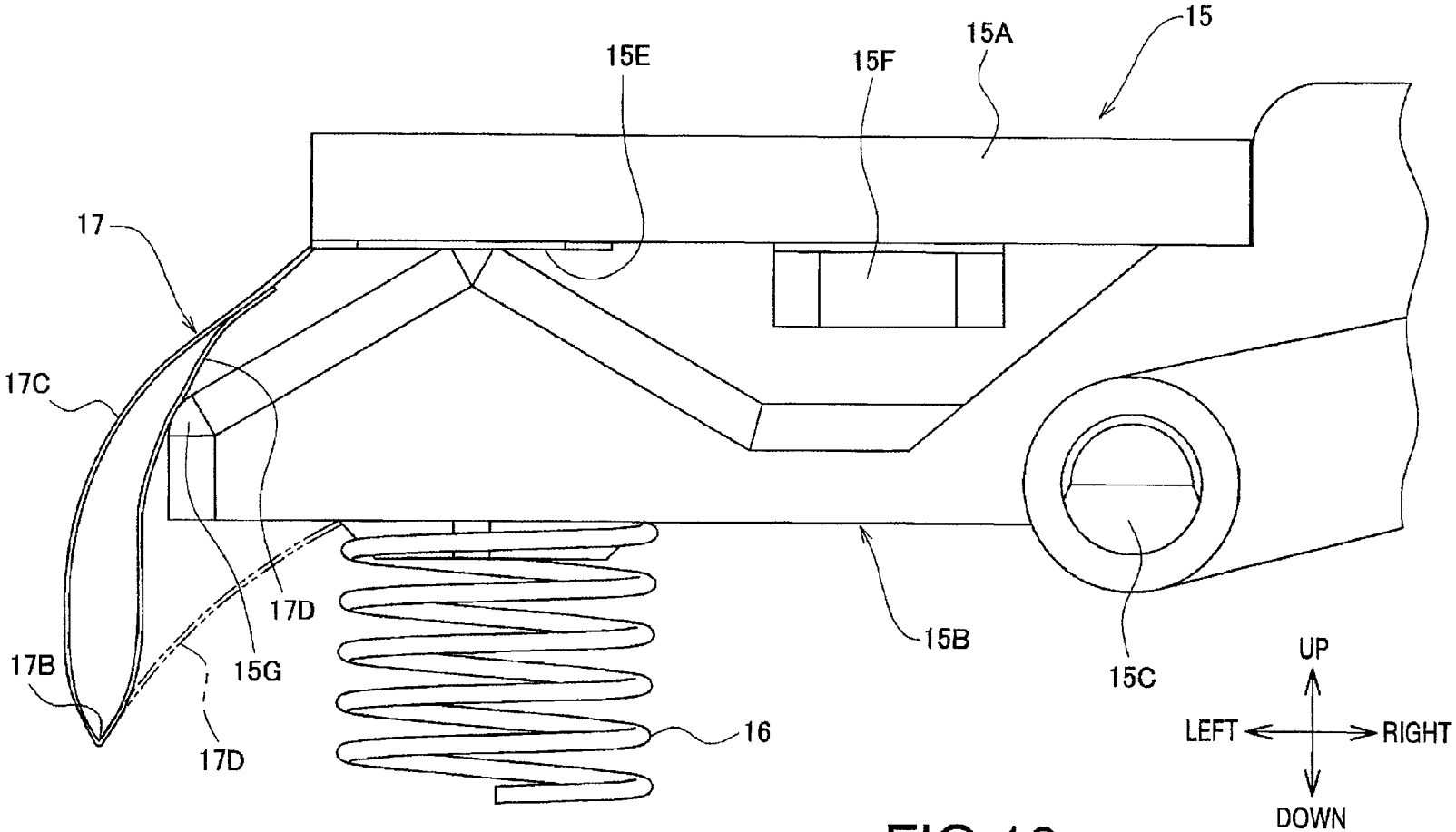
FIG. 10 is a side view of the pad assembly of the ADF according to a fourth embodiment of the present invention.

When the second slidable surface is in the position underneath the first slidable surface 17C, as indicated by solid lines in FIG. 10, the worker can see the backside of the second slidable surface 17D through the opening 17G and recognize that the second slidable surface 17D is in contact with the second slidable section 15G. On the other hand, when the slidable surface 17C is not in the position underneath the first slidable surface 17C, as indicated by double-dotted lines in FIG. 10, the backside of the second slidable surface 17D is not visible through the opening 17G, and it is recognized that the second slidable surface 17D is not in contact with the second slidable section 15G.

Thus, the worker can recognize the condition of the slidable film 17 in the pad assembly 15 easily by the visual inspection and determine as to whether the pad assembly 15 is correctly installed in the base cover.

During the inspection, if the holder 15B and the backside of the second slidable surface 17D are in similar colors, the worker may see through the opening 17G the holder 15B but incorrectly recognize that he/she is seeing the second slidable section 17D. That is, the worker may not clearly recognize the condition of the slidable film 17. Therefore, it is desirable that the holder 15B, specifically the second slidable section 15G, and the backside of the second slidable surface are in visually distinguishable colors. For example, the holder 15B may be colored in white, and the slidable film 17 may be colored in black.

Alternatively or additionally to the visual inspection through the opening 17G, for example, the condition of the second slidable surface 17D may be monitored by an optical sensor such as a charge-coupled device (CCD) through the opening 17G in the first slidable surface 17C.

More Examples

Although examples of carrying out the invention has been described, those skilled in the art will appreciate that there are numerous variations and permutations of the sheet conveying device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the slidable film 17 may not necessarily be fixed to the edge closer to the swingable end 15D in the separator pad 15A but may be arranged in a position closer to the swing axis 15C than the swingable end 15D. In this regard, the slidable film 17 may be arranged to urge the first slidable section 11B along a direction parallel with the swing axis 15C.

Further, the separator pad 15A may not necessarily be fixed to the separator pad 15A but may be fixed to, for example, the holder 15B.

For another example, the first slidable section 11B may not necessarily be integrally formed with the base cover 11 but may be formed separately. The separately-formed first slidable section 11B may be fixed to the base cover 11 when the ADF 10 is assembled.

Further, the positions of the separator roller 14 and the separator pad 15A may be switched with each other. That is, the separator roller 14 may be arranged on the lower side of the sheet stack along the direction of height of the sheet stack, and the separator pad 15A may be arranged on the upper side of the sheet stack. In this regard, the sheets are picked up one-by-one from the lowermost sheet.

Furthermore, the resiliently-deformable material for the slidable film 17 may not necessarily be PET. For example, the slidable film 17 may be a piece of sponge or rubber.

For another example, the swing shaft 15C of the holder 15B in the pad assembly 15 and the shaft hole formed in the base cover 11 may be switched with each other. That is, the base cover 11 may be formed to have a swing shaft whilst the holder B in the pad assembly 15 may be formed to have a shaft hole for the swing shaft in order to have the holder B swingable with respect to the base cover 11.

The above-described sheet conveying device may not necessarily be applied to the auto document feeder 10, which conveys sheets of original documents in an image reading apparatus. For example, the sheet conveying device may be applied to a sheet feeder, which feeds unused sheets in a sheet path in an image forming apparatus.

In the third and fourth embodiments described above, the slidable film 17 is simply folded in two; however, additional processes to adjust the resiliency and/or the friction force to be caused may be applied to the slidable film 17. For example, one or more slits may be formed in or around the crease 17B.

In the third and fourth embodiments described above, the slidable film 17 is folded at the line 17B to form the crease; however, the slidable film 17 may not necessarily be distinctly folded. For example, the slidable film 17 may be plastically curved when installed in the base cover 11 but recoverable to the original plane sheet when removed from the base cover 11.

In the third and fourth embodiments described above, the slidable film 17 is folded in two in a shape of "V"; however, the slidable film 17 may be folded at a plurality of lines into three or more planes. For example, the slidable film 17 may be folded in four in a shape of "W." For another example, the slidable film 17 may be folded in a stepped shape.

In the third and fourth embodiments described above, a single slidable film 17 is folded to have the first slidable surface 17C and the second slidable surface 17D; however, a plurality of slidable films, each of which has the first slidable surface 17C and the second slidable surface 17D, may be provided.

The specific features and acts described above are disclosed as example forms of implementing the claims, and the present invention may be applied to other sheet conveying devices as long as the pad assembly 15 and the base cover 11 are arranged to be slidable with each other, and the self-excited vibration in the pad assembly 15 is dampened by the friction force caused in the sliding sections.

What is claimed is:

1. A sheet conveying device, which conveys a sheet in a sheet path separately from a sheet stack, comprising:

a separator roller, which is arranged on one end of the sheet stack in a direction of a height of the sheet stack and which is configured to be rotatably in contact with the sheet to apply a conveying force to the sheet;

a pad assembly including a separator pad, which is arranged on an opposite end of the sheet stack than the separator roller and which is configured to be in contact with the sheet stack to apply resistance to the sheet stack, and a holder, which is swingably attached to a base member and which holds the separator pad, the base member being in a fixed position with respect to the separator roller;

a spring, which urges the pad assembly toward the separator roller; and a slidable film, which is attached to the pad assembly and configured to be integrally movable with the pad assembly and to be slidably in contact with a first slidable section in the base member, wherein the slidable film is configured to be slidably in contact with a second slidable section in the pad assembly, and wherein the second slidable section is provided in the holder.

2. The sheet conveying device according to claim 1, wherein the pad assembly includes a swingable end, which is at a furthest position from a swing shaft of the holder along a direction orthogonal to an axial direction of the swing shaft; and wherein the slidable film is arranged on a side closer to the swingable end in the pad assembly than to the swing shaft.

3. The sheet conveying device according to claim 2, wherein the slidable film is made of a resiliently-deformable material.

4. The sheet conveying device according to claim 3, wherein the slidable film has a surface configured to be in slidable contact with the first slidable section.

5. The sheet conveying device according to claim 4, wherein the swingable end of the pad assembly is located downstream of the swing shaft in a direction of sheet-conveyance;

wherein the first slidable section in the base member is located downstream of the swingable end in the direction of sheet-conveyance and is separated from the swingable end via a clearance;

wherein the slidable film has a fixed end, which is fixed to the pad assembly, and a drooping end, which extends from the fixed end and droops downstream of the swingable end; and wherein the slidable film is slidably in contact with the first slidable section within a range between the fixed end and the drooping end.

6. The sheet conveying device according to claim 5, wherein the slidable film comprises a width, which is orthogonal to a direction of a thickness of the slidable film, and is attached to the pad assembly at the fixed end in an orientation such that the width is orthogonal to an extending direction of the slidable film; and wherein the slidable film is symmetrical about a center of its width, wherein a length of the width at the drooping end is smaller than a length of the width at the fixed end.

7. The sheet conveying device according to claim 5, wherein the base member comprises a recess, which accommodates the holder;

wherein the first slidable section is provided in an inner surface of the recess facing the swingable end of the pad assembly; and wherein the slidable film is slidably in contact with the first slidable section in a resiliently deformed condition such that the drooping end is configured to contact a bottom surface of the recess.

8. The sheet conveying device according to claim 7, wherein the second slidable section in the holder faces the first slidable section when the holder is accommodated in the recess; and wherein the slidable film applies a force, which urges the second slidable section away from the first slidable section, when slidably in contact with the first slidable section and the second slidable section.

9. The sheet conveying device according to claim 8, wherein the slidable film is folded into a plurality of planes to form at least one crease; and wherein the slidable film has a first slidable plane, which is slidably in contact with the first slidable section, on one side of the at least one crease, and a second slidable plane, which is slidably in contact with the second slidable section, on a different side of the at least one crease.

10. The sheet conveying device according to claim 9, wherein the crease extends in a direction parallel to an extending direction of the slidable film.

11. The sheet conveying device according to claim 10, wherein the slidable film has a fixable section, by which the slidable film is fixed to the separator pad, as a part of the first slidable plane; and wherein the slidable film has a jutting section, which juts toward the fixable section and which is interposed between the separator pad and the holder when the slidable film is arranged in the pad assembly, as a part of the second slidable plane.

12. The sheet conveying device according to claim 11, wherein the crease is formed at the drooping end of the slidable film and extends orthogonally to an extending direction of the slidable film.

13. The sheet conveying device according to claim 12, wherein the slidable film comprises an opening in the first slidable plane configured to permit observation of a backside of the second slidable plane.

* * * * *

UNITED STATES PATENT AND TRADEMARK OFFICE

CERTIFICATE OF CORRECTION

PATENT NO. : 8,695,964 B2
APPLICATION NO. : 13/070591
DATED : April 15, 2014
INVENTOR(S) : Masanori Hamaguchi et al.

It is certified that error appears in the above-identified patent and that said Letters Patent is hereby corrected as shown below:

Claims

Column 14, Claim 12, Line 33:
Please delete "claim 11" and replace with --claim 9--

Signed and Sealed this
Eighth Day of December, 2015

Michelle K. Lee

Michelle K. Lee
*Director of the United States Patent and Trademark Office*